United States Patent [19]

Kuhn

[11] 4,136,339

[45] Jan. 23, 1979

[54] CORONA REDUCING APPARATUS FOR A SUBMERSIBLE ELECTRICAL FUSE

[75] Inventor: Edmund W. Kuhn, Mt. Lebanon, Pa.

[73] Assignee: Westinghouse Electric Corp., Pittsburgh, Pa.

[21] Appl. No.: 773,460

[22] Filed: Mar. 2, 1977

[51] Int. Cl.[2] ..... G08B 21/00; H01H 85/32

[52] U.S. Cl. ..... 340/638; 337/224; 337/241

[58] Field of Search ..... 340/250, 252 R, 253 A; 174/11 BH; 324/133; 337/206, 222, 223, 224, 241, 242, 243, 266, 280

[56] References Cited

U.S. PATENT DOCUMENTS

| | | | |
|---|---|---|---|
| 2,036,223 | 4/1936 | Läpple | 340/250 |
| 2,593,426 | 4/1952 | Fahnoe | 337/224 |
| 2,735,088 | 2/1953 | Kinzer | 340/250 |
| 3,229,065 | 1/1966 | Borys | 337/266 |
| 3,513,427 | 5/1970 | Prosser et al. | 337/243 |
| 3,524,178 | 8/1970 | Stratton | 174/11 BH |
| 3,684,995 | 8/1972 | Horton | 337/224 |
| 3,686,603 | 8/1972 | Lockie et al. | 337/224 X |
| 3,946,351 | 3/1976 | Bronikowski et al. | 337/224 |
| 3,970,932 | 7/1976 | Harvey | 174/11 BH X |
| 4,035,755 | 7/1977 | Cameron | 337/38 D |

FOREIGN PATENT DOCUMENTS

| | | | |
|---|---|---|---|
| 157012 | 6/1954 | Australia | 340/250 |

*Primary Examiner*—Donald J. Yusko
*Assistant Examiner*—Daniel Myer
*Attorney, Agent, or Firm*—M. J. Moran

[57] ABSTRACT

Semiconductive paint is applied to a narrow strip on the inside surface of an insulating enclosure for a submersible fuse. The enclosure is generally watertight. The semiconducting paint marginally overlaps two isolated regions of electrically conducting paint. The combination of the conducting paint and semiconducting paint covers the entire inner surface of the enclosure and acts cooperatively to prevent or reduce corona therein. At the place of overlap, rounded ridges are provided for shielding the relatively sharp interface corner of the conductive paint on the inside surface of the electrically insulating material to reduce the corona at that relatively critical point. A flowable rubber gasket is provided for insertion between two separable portions of the enclosure. The gasket not only provides watertight sealing for the enclosure when completely assembled but has a bead on the inside surface thereof which shields the corners of the two portions of the enclosure to reduce the corona effects thereat.

5 Claims, 11 Drawing Figures

CORONA REDUCING APPARATUS FOR A SUBMERSIBLE ELECTRICAL FUSE

CROSS-REFERENCE TO RELATED APPLICATIONS

The subject matter of this invention is related to co-pending patent application Ser. No. 613,836, entitled "Non-venting Condenser For An Expulsion Fuse" filed Sept. 16, 1975 by F. L. Cameron. The subject matter of this invention is also related to co-pending concurrently filed application Ser. No. 773,459, by E. W. Kuhn and A. I. Bennett. Both of the above-mentioned patent applications are assigned to the assignee of the present invention.

BACKGROUND OF THE INVENTION

1. Field of the Invention

The subject matter of this invention relates generally to corona shielding apparatus and it relates more specifically to the utilization of corona shielding apparatus for the internal portion of an enclosure.

2. Description of the Prior Art

It is known to use conductive paint as a corona shielding means for the internal portion of an enclosure. It is also known to utilize gasketing material for sealing complementary portions of enclosures. It would be advantageous if means could be found for utilizing a portion of a gasket as a corona shielding means. I would also be advantageous if semiconductive paint could somehow be utilized as a shielding means. The semiconductive paint could provide the dual purpose of shielding sharp edges and of providing electrical isolation between conductive surfaces.

SUMMARY OF THE INVENTION

In accordance with the invention, a gasket for sealing the juncture between two separate sections of an enclosure when assembled is provided. The gasket has an internal portion thereof which has a bead thereon which when assembled covers the edges or corners of the two portions at the place where they join. This covering of the edges reduces the electric field effect which is pronounced at a sharp corner or edge. Furthermore, in a submersible fuse, the inside portion of an enclosure is coated with conducting paint, except at one central portion where a band of semiconductive paint is provided. The semiconductive paint is applied directly to the inner wall of a dielectric enclosure but slightly overlaps the edges of the conductive paint. Furthermore, a bead or ridge is provided in the semiconductive paint at the place where it overlaps the conductive paint thus providing a relatively arcuate surface to shield the sharp interface between the conductive paint and the interface of the dielectric material of the enclosure. This reduces the electric field in the aforementioned region.

BRIEF DESCRIPTION OF THE DRAWINGS

For a better understanding of the invention, reference may be had to the preferred embodiments shown in the accompanying drawings, in which.

DESCRIPTION OF THE PREFERRED EMBODIMENTS

Figure 1:
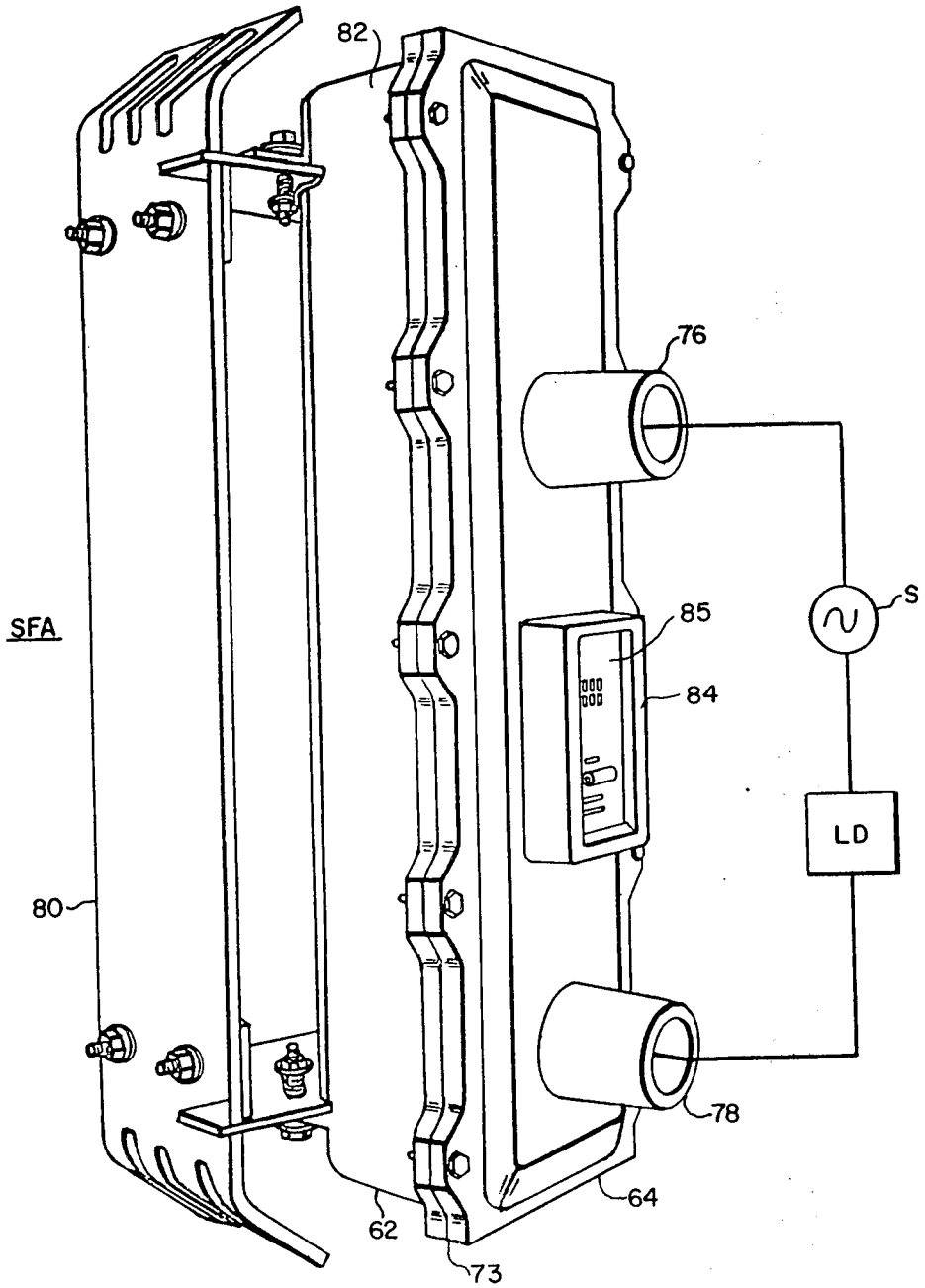
FIG. 1 shows an isometric view of a submersible fuse enclosure.

Referring now to the drawings and FIG. 1 in particular, a submersible fuse assembly SFA is shown. The fuse assembly SFA comprises an enclosure constructed by joining a bottom fuse assembly enclosure portion 62 with a top fuse assembly enclosure portion 64 and sealing the surfaces of the jointure with an appropriate gasket 73. The assembled fuse enclosure SFA is disposed upon a mounting apparatus 80. There are shown two terminal assemblies 76 and 78 to which are serially connected a schematically shown source of alternating current S and load LD. Shown disposed on one portion of the cover 64 is an indicator assembly 84 in which is disposed a printed circuit card 85, the use of which will be described hereinafter. The entire enclosure assembly SFA is coated with an electrically conductive layer of paint 82 so that the entire outer surface of the assembly may be maintained at electrical ground potential for safety.

Figure 2:
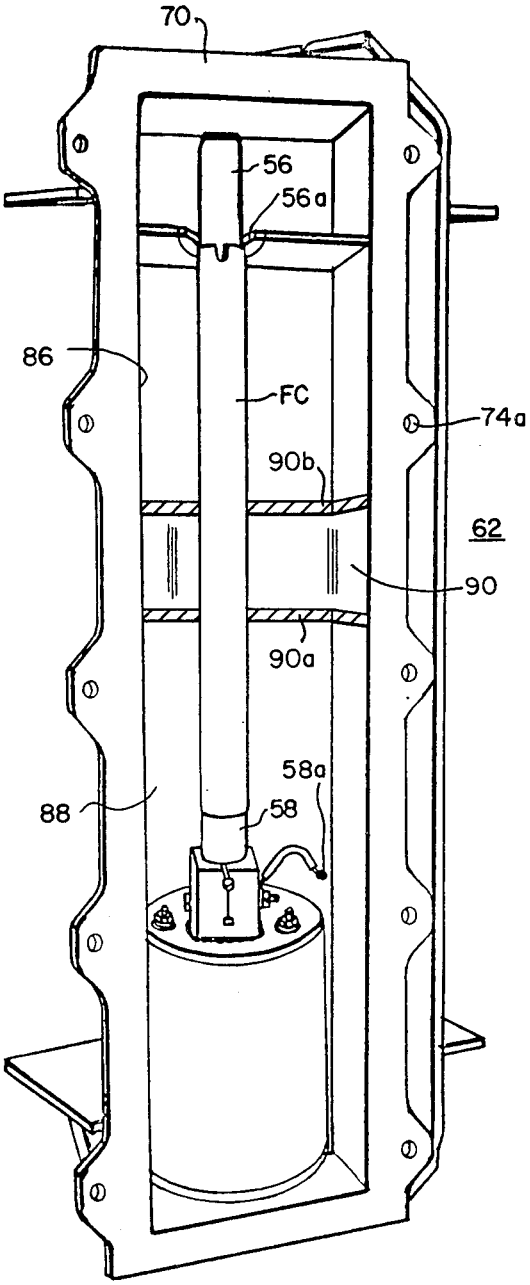
FIG. 2 shows an isometric view of the bottom portion of the enclosure of FIG. 1.

Referring now to FIG. 2, the lower portion 62 of the fuse enclosure assembly SFA is shown. The lower portion 62 has a fuse FC disposed therein. The fuse FC has two ferrules 56 and 58. The inner surface of the enclosure portion 62 is painted with a thin layer of conductive paint at regions 86 and 88. The main body of the enclosure portion 62 comprises electrically insulating material having a relatively high dielectric constant for electrical insulating purposes. The conductive paint regions 86 and 88 are disposed on the inner surface of that dielectric material. Disposed on the inner surface between the two sections of conductive paint 86 and 88 is a thin annular layer of semiconductive paint 90 which overlaps the conductive paint of regions 86 and 88 in marginally small regions **90*b* and 90*a*. Effectively, the semiconductive paint 90 electrically isolates the conductive inner surface 86 from the conductive inner surface 88. It will be noted that ferrule 56 is generally in the vicinity of the conductive electrical surface 86 and is electrically connected thereto at 56*a* and that ferrule 58 is the vicinity of the conductive surface 88 and is electrically connected thereto at 58*a*. A flat joining surface 70 is shown as well as openings 74*a*** through which bolts or the like may protrude for fastening purposes.

Figure 3:
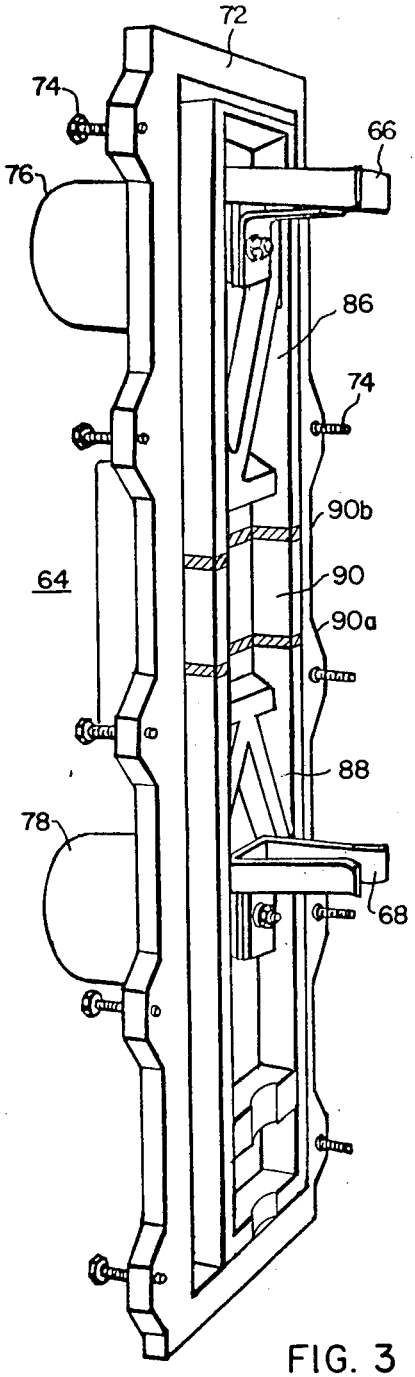
FIG. 3 shows an isometric view of the top portion of the enclosure of FIG. 1.

Referring now to FIG. 3, the top or complementary portion or cover 64 of the enclosure SFA shown in FIG. 1 is shown. It will be noted that enclosure portion 64 has two electrically conductive ferrule conductors 66 and 68 which are to be electrically interconnected with ferrules 56 and 58 when the enclosure SFA is assembled. The terminals 66 and 68 are connected in electrical circuit relationship with the terminal assemblies 76 and 78, respectively. The inner portion of the top cover 64 has disposed thereon thin layers of electrically conductive paint in the regions 86 and 88 separated by the marginally overlapping semiconductive paint 90. This is in correspondence with the similarly identified regions shown in FIG. 2. Consequently, when the top cover 64 is joined with the bottom portion 62 to form the completed apparatus shown in FIG. 1, the region 86 comprises a continuous internal conducting portion and the region 88 comprises a separate continuous internal conducting portion, both of which are separated by the continuous annular ring 90. When assembled, a flat joining surface 72 shown in FIG. 3 is disposed to align with the surface 70 shown in FIG. 2. In a preferred embodiment of the invention, a gasket 73 (shown partially in FIG. 10) is disposed between the latter two surfaces and is compressed therebetween by the action of turning the fasteners 74 on appropriate latch means disposed on the other side of the hole 74*a* shown in FIG. 2. It will be noted that the internal periphery of the surface 70 of FIG. 2 and the internal periphery of the surface 72 shown in FIG. 3 comprise relatively sharp edges which if not properly electrostatically shielded, become regions of relatively high electrical field intensity at which corona may cause flashover which in turn may cause dielectric deterioration in the top cover 64 or the bottom portion 62 or both. A suitable shielding arrangement is taught hereinafter with respect to FIG. 10.

Figure 4:
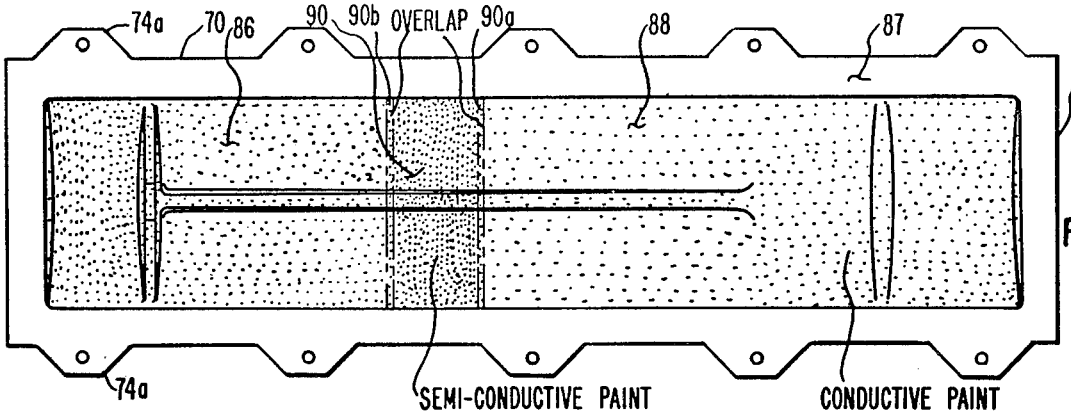
FIG. 4 shows a plan view of the bottom portion of the enclosure of FIG. 1.
Figure 5:
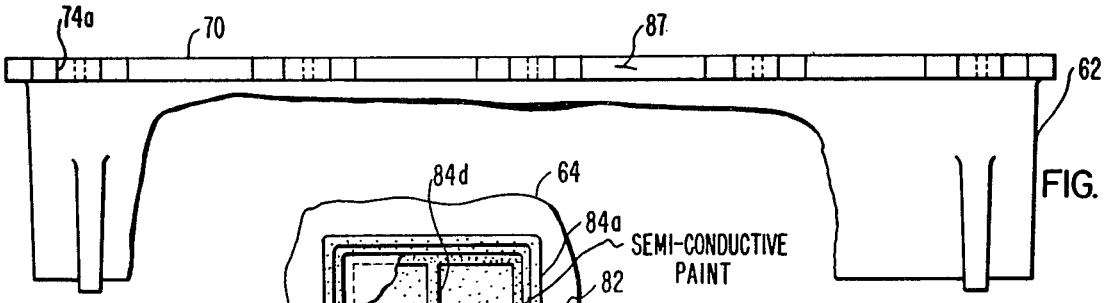
FIG. 5 shows a side elevation of the enclosure portion shown in FIG. 4.
Figure 6:
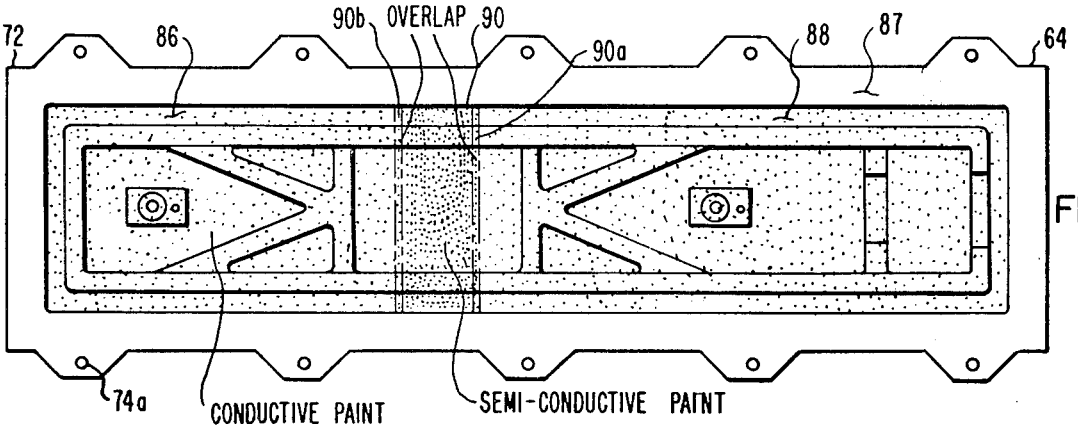
FIG. 6 shows a plan view of the top portion of the enclosure of FIG. 1.

Referring now to FIGS. 4 through 8, plan and elevation views of the bottom portion 62 and top cover 64 are shown as well as a broken-away portion of the capacitive coupling region for the indicator 84. Particular reference to FIGS. 4 through 6 show dielectric material 87 comprises the basis for the enclosure portions 62 and 64. It can be therefore seen that either or both of the enclosure portions 62 and 64 may comprise capacitors, that is two spaced conductive plates separated by a region of dielectric material. In this case, the dielectric material is obviously 87 and the spaced conductive plates comprise in one instance internal conductive surface 86 and a portion of the external conductive surface 82 and in the other instance, conductive surface 88 and another portion of the external conductive surface 82. For purposes of clarity, it is to be understood that the actual capacitive plates associated with the outer surface 82 of the various capacitive means are small conductive regions 82*e* and 82*f* which will be described more fully hereinafter with respect to FIGS. 7 and 8.

Figure 8:
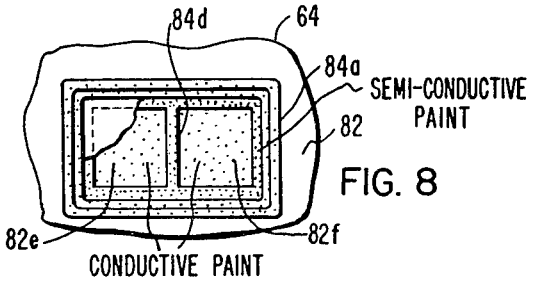
FIG. 8 shows a view of a portion of the outer surface of the top cover shown in FIGS. 6 and 7.
Figure 7:
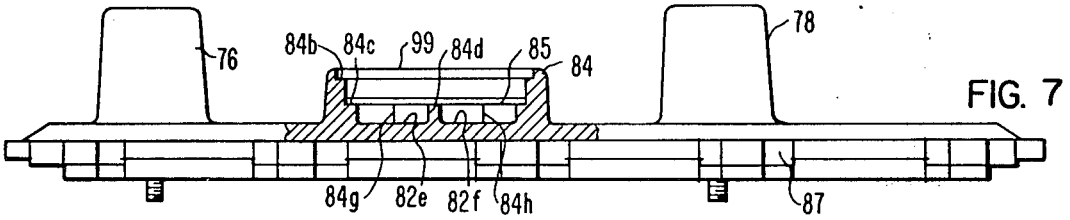
FIG. 7 shows a side elevation of the enclosure portion shown in FIG. 6.

Referring now more specifically to FIGS. 7 and 8, it can be seen that the indicator 84 of FIG. 1, comprises a raised portion 84*a* which completely surrounds two isolated electrically conductive regions 82*e* and 82*f*. The raised portion 84*a* has two ridges 84*b* and 84*c* therein, onto which a transparent covering 99 and a printed circuit board 85 are respectively placed or disposed. Elements on the printed circuit board 85 are serially connected to the conductive regions 82*e* and 82*f* by way of conductors 84*g* and 84*h* respectively. The indicator portion 84 includes a raised central portion 84*d* the top surface of which is aligned with the previously described ridge 84*c*. Consequently, the conductive portions 82*e* and 82*f* are well isolated from one another by the vertical walls of the central ridge portion 84*d*. It is to be understood that the entire conductor assembly 84 is coated with conductive paint except for the ridge 84*c* and the ridge 84*d* which are covered with semiconductive paint which may be similar to the paint 90 shown in FIGS. 4 and 6. Furthermore, the surfaces or capacitor plates 82*e* and 82*f* are electrically conducting. Finally, it is to be understood that the member 99 may comprise plastic, glass or other electrically insulating material which is relatively transparent. In the preferred embodiment of the invention, an electrical neon light is disposed immediately above the printed circuit board 85 but beneath the transparent pane 99. This is to prevent personnel from making electrical contact with the surfaces 82*e* and/or 82*f*. As will be discussed later, the relative voltages impressed across the various portions of the latter mentioned members and surfaces of indicator 84, are not appreciably large when compared with the potential voltages within the enclosure. Nevertheless, personnel protection is provided for safety. By referring to FIGS. 6 and 7, it can be seen that conductive surface 82*e* is aligned at least partially with conductive surface 86 on the inner portion of the enclosure. Likewise, conductive surface 82*f* is aligned with conductive surface 88 on the inner portion of the enclosure 64. Consequently, capacitive coupling is possible through the main body of the dielectric material 87 between the plate 82*e* and the conductive surface 86 in one instance, and between the plate 82*f* and the conductive surface 88 in the other instance. The remaining portions of the indicator 84 are serially connected between the latter two mentioned capacitor regions by way of the conductors 84*g* and 84*h*.

Figure 9:
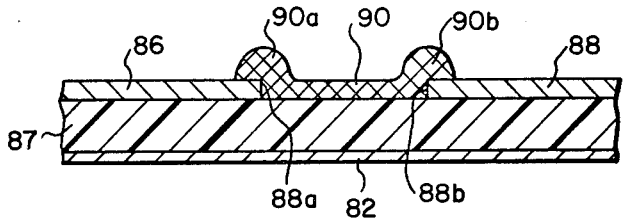
FIG. 9 shows a broken away portion, in section of a portion of the enclosure of FIG. 1 in the region where semiconductive paint is disposed in overlapping relationship with conductive paint.

Referring now to FIG. 9, a broken-away section of the enclosure in the region of the annular semiconductive ring 90 is shown. It is to be understood that this section is shown in exaggerated configuration. The outer layer of relative thin conductive paint 82 is shown as well as the two spaced layers of electrically conductive paint 86 and 88. Sandwiched between the conductive layer 82 and the conductive layers 86 and 88 is the dielectric material 87 of the main body of the fuse enclosure. It will be noted that the relatively sharp corners 88*a* and 88*b* of the terminated conductive surfaces 86 and 88 are potential areas of high electric field strength at which corona discharge may occur. However, these corners are shielded by beads or mounds of semiconductive material 90*a* and 90*b* respectively. It is also to be noted that the semiconductive paint 90 overlaps the conductive paint 86 and 88. In a preferred embodiment of the invention, the semiconductive paint is approximately two inches wide and completely encircles the inside of the completely assembled enclosure SFA. The device as thus constructed supports the integrity of the fuse in case of a fault. Full line potential or voltage to ground from either terminal assembly 76 or 78 after fuse interruption will appear across this two inch width. The ultimate purpose of the combination of the conductive surfaces 86 and 88 utilized in conjunction with the overlapping and mounded semiconductive surface 90 is primarily to reduce corona discharge within the enclosure. Utilization of the capacitive effect between the internal conductive surfaces 86, 88 and the external conductive surface 82 assists in providing the indicating function.

Figure 10:
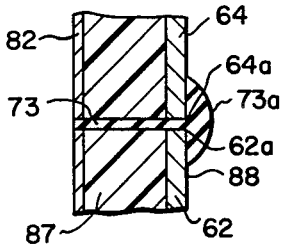
FIG. 10 shows a sectional view, partially broken away of the enclosure of FIG. 1, at the place where the top portion is joined to the bottom portion.

Referring now to FIG. 10, a cross-section of a broken-away portion of the top cover 64 and the bottom portion 62 in the region of a gasket 73 is shown. The outer conductive surface 82 and the inner conductive surface 83 (in this case) are shown on opposite sides of the dielectric material 87 of the main body of the enclosure SFA. The capacitive qualities of the arrangement as thus constructed are easily visualized in this Figure. It will be noted that the relatively sharp corners or edges 64*a* and 62*a* of the mating or complementary portions 64 and 62 respectively are regions of high electric field strength at which flashover or corona is relatively more likely to occur. It is desirable to shield these corners with an arcuate surface such as may be formed by an extension of the gasket 73 into the internal portion of the enclosure to form the bead 73*a*. Bead or shield 73*a* thus reduces the effect of the high electric field at the corners 64*a* and 62*a*. This reduces the relative likelihood for corona formation or flashover inside of the enclosure. In this case, the presence of the gasket 73 also excludes the presence of air between the edges of the conductive or semiconductive paint at the juncture of the top and bottom sections 64 and 62. This condition provides shielding which reduces corona around the edges 62*a* and 64*a* along the entire periphery of the assembled enclosure. Placement of the gasket in the manner shown may be obtained by extruding excess gasket material to the inside when clamping the top section to the bottom section or by forming the gasket initially with a bead. The gasket material may be applied as a flowable liquid, consequently after assembly of the top portion against the bottom portion the assembly may be oriented in such a manner as to allow the bead 73*a* to be formed. This completely covers the junction of both the top and bottom sections.

Figure 11:
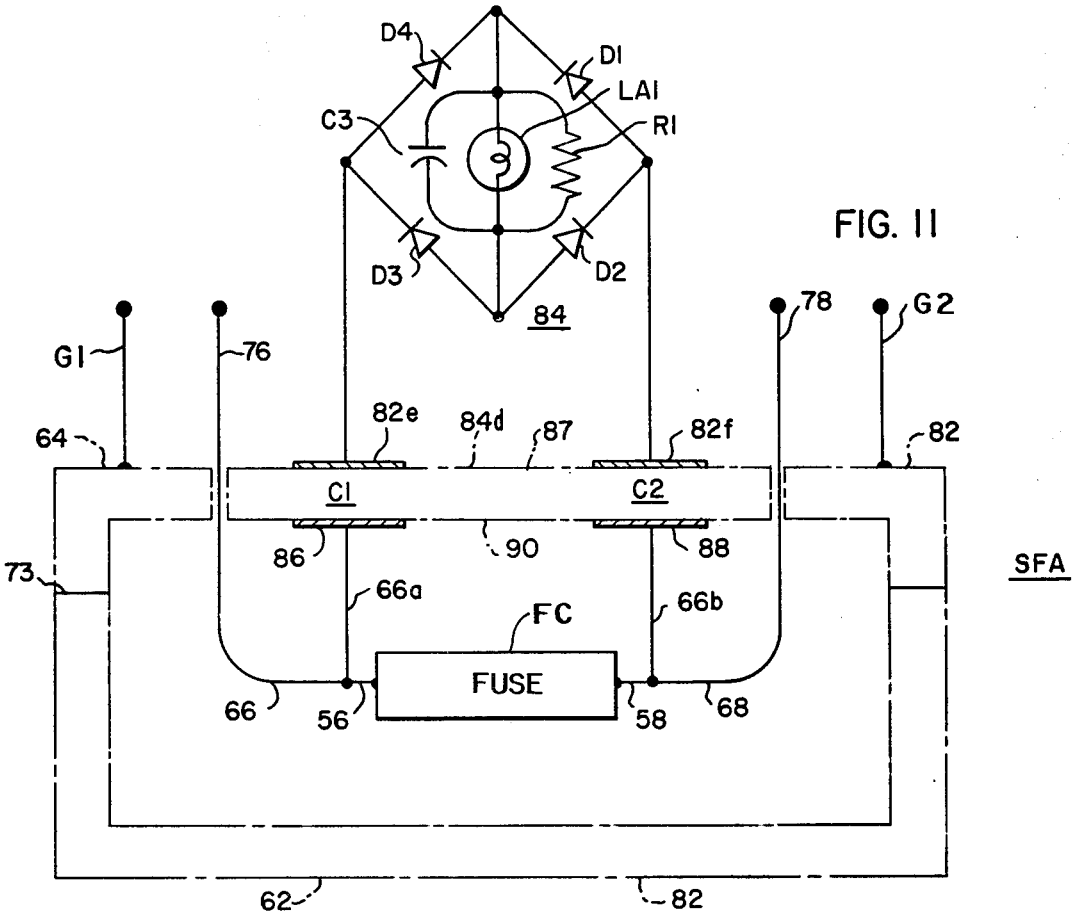
FIG. 11 shows a schematic circuit diagram of the indicator and fuse apparatus of the enclosure of FIG. 1.

Referring now to FIG. 11, a schematic diagram of a submersible fuse with indicating means is shown. The gasket 73 is shown schematically separating the top portion or cover 64 from the bottom portion 62. A fuse FC is disposed within the central part of the enclosure. The ferrules of the fuse are represented schematically at 56 and 58. The spring loaded connectors are indicated schematically at 66 and 68 and the external terminal assemblies are shown schematically at 76 and 78, respectively. Although not shown in other embodiments of the invention, electrically conductive leads 66*a* and 66*b* may be attached to ferrules 56 and 58 to connect the ferrules to the internal wall portions of the completed fuse assembly SFA. One capacitor place for the ferrule 56 is shown schematically at 86 and one capacitor plate for the ferrule 58 is shown schematically at 88. The complementary spaced capacitor conductors 82*e* and 82*f* for plates 86 and 88 respectively are shown on the outside of the dielectric material 87, thus forming the two capacitors C1 and C2 respectively. A diode bridge arrangement comprising the diodes D1 through D4 are interconnected to the plates 82*e* and 82*f*. In such a manner as to interconnect the parallel combination of the capacitive element C3, the lamp LA1 and the resistive element R1 in series circuit relationship with the capacitive elements C1 and C2. During normal operating conditions, when the fuse FC is not blown, currents flowing in capacitive elements C1 and C2 are relatively equal and consequently the voltage across the input terminals of the bridge D1–D4 is zero, thus substantially preventing energization of the lamp LA1. In fact, slight variations in capacitance and other physical quantities of the apparatus may cause the voltage to be slightly larger than zero, however, the lamp LA1 has a minimum value of voltage at which it will illuminate and this value is not easily unintentionally attained because capacitive element C3 cannot be easily charged to a voltage sufficient to illuminate the lamp LA1 if the currents in capacitive elements C1 and C2 are generally equal and opposite. In the later case, the resistive element R1 acts as a leakage resistor which shunts current from the capacitive element C3 to prevent it from being charged significantly. However, should the fuse FC blow, then either the terminal assembly 76 or the terminal assembly 78 will become significantly higher in voltage potential than the other. The reason for this is that one of the terminals of the terminal assembly 76 or 78 is connected to a high voltage source (not shown) while the other of the terminals 78 or 76 respectively is connected to a load (not shown). It is not important which of the terminals 76 or 78 is connected to the load and which is connected to the source nor need it be known when installing the fuse. The diode arrangement D1 through D4 is such that the indicator device will work regardless of which side of the fuse is connected to the load and which side is connected to the source. It will be noted that two ground connections G1 and G2 are shown, although this is not limiting. These provide a means for connecting the outer conductive surface 82 to ground to establish ground potential thereupon. It will also be noted that the semiconductive region 90 exists between the capacitive plates 86 and 88 on the internal portion of the enclosure whereas the semiconductive region 84*d* exists between the plates 82*e* and 82*f* on the external portion of the enclosure. Presuming for purposes of illustration that the terminal of the terminal assembly 76 is connected to the high voltage source and that the terminal of the terminal assembly 78 is connected to a load, when the fuse FC blows, plate 86 will be at a significantly higher potential than plate 88. The semiconductive surface 90 will act to gradually grade the voltage between plate 86 and 88 to prevent flashover therebetween. The semiconductive paint 90 has the characteristic of maintaining the voltage integrity of the blown fuse between the ferrules 56 and 58 without setting up high field voltage discontinuities which could cause flashover. In the latter case, the capacitive element C1 will have established thereacross most of the voltage which is present between ground and the ferrule 56. Some embodiments of the invention have a maximum voltage available between ferrule and ground of between 15 kilovolts and 60 kilovolts. In this case, all but approximately 150 to 200 volts of this is dropped across the capacitive element C1. The remaining voltage is dropped across the parallel combination of the capacitive element C3, the lamp LA1, and the resistive element R1. The other capacitive element C2 returns the current in the series connected indicator 84 to ground either through leakage to the outer surface 82 or through the load connected to the terminal 78. When the potential difference between the input terminals of the bridge is sufficiently high, capacitive element C3 is quickly charged to a voltage sufficient to break down the lamp LA1 which may be a neon lamp or the like. This then causes the neon lamp to provide a discharge path for the charge which has been accumulated in the capacitive element C3. The discharge is relatively rapid and of course intermittent. The relatively rapid discharge and the intensity of the pulse of the discharge causes a relatively intense illumination of the lamp LA1. Were the lamp to conduct continuously rather than intermittently, the average value of current flowing therethrough would be such that the intensity of illumination would be less even though the lamp were on for a longer period of time. Consequently, when the fuse FC is blown, the lamp LA1 operating in conjunction with the capacitive element C3 will flash brilliantly and intermittently at a frequency determined by the value of the capacitive element C3 among other things. In this case, the diode D4 and the diode D2 act to conduct electrical current but the diodes D1 and D3 do not pass substantial electrical current.

It is to be understood with respect to the embodiments of the invention that not all of the inventive concepts taught herein need be used simultaneously for the other inventive concepts to be effective. It is also to be understood that the schematic diagram shown in FIG. 11 should not be considered as limiting. It is merely a representation of the interrelationship of important inventive elements. The conductive plates 86 and 88 of the capacitive elements C1 and C2 may occupy substantially greater portions of the internal part of the enclosure than is depicted in FIG. 11. It is also to be understood that the arrangement of the indicating means 84 as shown in FIG. 1, on the side or top of the completely assembled enclosure SFA is not necessarily limiting and long leads may be utilized between the enclosure and the indicator 84 to provide more convenient indications in same embodiments. It is also to be understood that the device to be enclosed by the enclosure SFA not be limited to a fuse but may in some instances be a circuit breaker or a circuit interruptor of some other kind. It is also to be understood that FIGS. 9 and 10 are shown in generally exaggerated dimension for purposes of simplicity of illustration.

The apparatus taught herein has many advantages. One advantage lies in the fact that the semiconductive material which is utilized to provide integrity for the fuse element also performs the function of shielding the relatively sharp corners of the semiconductive paint thus eliminating areas of high concentrated electric field strength. Another advantage lies in the fact that the gasket material used herein whether extruded or otherwise provides a bead of material against the edges of the assembled portions of the enclosure to reduce the field intensity at the edges to prevent flashover or corona or other undesirable effects. Another advantage lies in the fact that the raised portions 90*a* and 90*b* as shown in FIG. 9 for example provide a longer lateral distance for isolating the conductive surfaces 86 and 88 from one another. This correspondingly reduces the likelihood of flashover along the outer surface of the semiconductive paint 90 in the gas which may abut thereagainst.

What I claim as my invention is:

1. A fuse assembly, comprising:

(a) enclosure means having a pair of spaced terminals thereon which extend from the inside of said enclosure means to the outside thereof, the inside surface of said enclosure means being substantially covered in two regions with a layer of conducting material, said later material not being present in a third region which exists between said spaced terminals, said third region being substantially covered by a thin layer of semiconducting material, said semiconducting material having a raised ridge portion which also overlaps the interface where said conducting material terminates on said inside surface to reduce corona in the region of said interface;

(b) fuse means disposed within said enclosure means in circuit relationship with said spaced terminals, said conductive material and said semiconductive material cooperating to reduce corona within said enclosure when said fuse is electrically energized, said semiconductive material isolating said two conducting regions when said fuse is blown; and (c) indicator means disposed outside of said enclosure means but capacitively coupled to at least one of said two conductive regions within said enclosure means to give an indication when said fuse is blown.

2. The combination as claimed in claim 1 wherein said enclosure means comprises a plurality of separable portions, wherein a gasket is disposed between said separable portions to form a seal when said enclosure is in an assembled state, said gasket having a portion with a curvalinear surface which protrudes into said inside of said enclosure and which overlaps the edges of said separable portions to reduce corona in the region of said edges.

3. The combination as claimed in claim 1 wherein said semiconductive material comprises paint.

4. A fuse assembly, comprising:

(a) an enclosure having a pair of spaced terminals thereon which extend from the inside of said enclosure to the outside thereof, the inside surface of said enclosure being substantially covered in two regions with a layer of conducting paint, said paint not being present in an annular ring which is continuous around said inside surface between said spaced terminals, said latter ring being covered by semiconducting paint which overlaps said conducting paint to form a corona shield for the interfaces of said paint;

(b) fuse means disposed within said enclosure in said circuit relationship with said spaced terminals, said conductive paint and said semiconductive paint cooperating to reduce corona within said enclosure, said semiconductive material isolating said two conducting regions when said fuse is blown; and (c) indicator means disposed outside of said enclosure but serially capacitively coupled to said two conductive regions within said enclosure to give an indication when said fuse is blown.

5. The combination as claimed in claim 4 wherein said enclosure comprises a plurality of separable portions, wherein a gasket is disposed between said separable portions to form a seal when said enclosure is in an assembled state, said gasket having a portion with a curvalinear surface which protrudes into said inside of said enclosure and which overlaps the edges of said separable portions to reduce corona in the region of said edges.

* * * * *